US009508334B1

(12) United States Patent
D'Antonio

(10) Patent No.: US 9,508,334 B1
(45) Date of Patent: Nov. 29, 2016

(54) ACOUSTICAL TREATMENT WITH TRANSITION FROM ABSORPTION TO DIFFUSION AND METHOD OF MAKING

(71) Applicant: RPG DIFFUSOR SYSTEMS, INC., Upper Marlboro, MD (US)

(72) Inventor: Peter D'Antonio, Upper Marlboro, MD (US)

( * ) Notice: Subject to any disclaimer, the term of this patent is extended or adjusted under 35 U.S.C. 154(b) by 0 days.

(21) Appl. No.: 15/050,977

(22) Filed: Feb. 23, 2016

(51) Int. Cl.
*G10K 11/168* (2006.01)
*G10K 11/20* (2006.01)
*E04B 1/84* (2006.01)

(52) U.S. Cl.
CPC ..... *G10K 11/168* (2013.01); *E04B 1/84* (2013.01); *G10K 11/20* (2013.01); *E04B 2001/8414* (2013.01)

(58) Field of Classification Search
CPC ..... G10K 11/168; G10K 11/20; E04B 1/84; E04B 2001/8414
USPC ..... 181/286, 290
See application file for complete search history.

(56) References Cited

U.S. PATENT DOCUMENTS

| | | | | |
|---|---|---|---|---|
| 5,401,921 | A | 3/1995 | D'Antonio et al. | |
| 5,512,715 | A * | 4/1996 | Takewa | E04B 1/86 181/286 |
| 5,817,992 | A | 10/1998 | D'Antonio | |
| 5,824,973 | A * | 10/1998 | Haines | B32B 5/22 181/286 |
| 6,112,852 | A | 9/2000 | D'Antonio et al. | |
| 6,772,859 | B2 | 8/2004 | D'Antonio et al. | |
| 7,428,948 | B2 | 9/2008 | D'Antonio et al. | |
| 2002/0029929 | A1 * | 3/2002 | Tinianov | E04B 1/86 181/290 |
| 2015/0020679 | A1 * | 1/2015 | Oxford | F41H 3/00 89/36.02 |

* cited by examiner

*Primary Examiner* — Jeremy Luks
(74) *Attorney, Agent, or Firm* — H. Jay Spiegel

(57) ABSTRACT

The essence of the present invention is that the thickness of a diffusive fascia of an acoustical treatment is directly correlative of the transition frequency between absorption and pure diffusion. Applicant has found that the thicker the fascia, the lower the transition frequency. For a fascia 600 microns thick, the transition between absorption and diffusion is at about 250 Hz; for a fascia having a thickness of 300 microns, the transition frequency is at about 500 Hz; for a micro-perforated fascia having a thickness of 150 microns, the transition frequency is at about 1,000 Hz; for a fascia having a thickness of 100 microns, the transition frequency is at about 2,000 Hz. An acoustical treatment is created taking these criteria into account. A method of making is also disclosed.

20 Claims, 12 Drawing Sheets

ACOUSTICAL TREATMENT WITH TRANSITION FROM ABSORPTION TO DIFFUSION AND METHOD OF MAKING

BACKGROUND OF THE INVENTION

The sound that we perceive in a space is a combination of the direct sound, early reflections from boundary surfaces and elements in the room and the later arriving dense reflections forming the reverberant sound. Consequently, the control of reflections is essential to providing an acoustical environment suitable for the purpose of the space. Reflections can be controlled by only three types of surface treatment, namely absorption, reflection and diffusion. Sound is attenuated by absorption, redirected by reflection and uniformly scattered by diffusion.

Absorption is the most common type and, in fact, most people refer to acoustical surfaces as absorptive surfaces. This is unfortunate because reflective and diffusive surfaces are equally important. Examples of high-mid frequency absorbing surfaces include acoustical ceiling tile, fabric wrapped fiberglass panels, drapery, carpeting, etc.

Low frequency absorbers include membrane and Helmholtz resonators. Reflecting surfaces include any flat surface, such as drywall, glass, etc, in which the reflected sound is directed at an angle equal to the angle of incidence. Diffusing surfaces have historically included shapes used in classic architecture, such as statuary, coffered ceilings, relief ornamentation, columns, etc. While these surfaces are useful and beautiful, they scatter sound over a limited range of frequencies.

Beginning in the early 1980s, new types of mathematically designed diffusing surfaces were introduced. These included reflection phase gratings, binary and ternary amplitude gratings and optimized surface shapes, all of which are reviewed below.

Traditional mineral fiber or fiberglass ceiling tile and fabric wrapped panels offer reflection and reverberation control by absorbing sound. Typically, these porous materials preferentially absorb sound in the high and mid frequencies, because the absorption mechanism is based on particle velocity and air movement is low near or on a boundary surface. Absorption is improved if there is an air cavity between the boundary and the porous material. While these conventional absorptive surfaces are useful in controlling high and mid frequency reflections, they can introduce an acoustically "dead" space, because they are removing the ambient sound frequencies. In addition, because they offer minimal low frequency absorption, preferential removal of high frequencies can create the impression of a reverberant space that contains excessive low frequencies and hence can sound "boomy". This situation is further exacerbated by the fact that most spaces contain additional surfaces that absorb high frequencies, such as carpeting, drapery and people. Hence, exclusive use of traditional absorptive ceiling tile and fabric wrapped panels can tilt the reverberation response of a room such that the highs are attenuated and the lows are untreated.

What would solve this problem is to develop a tile and panel that offers pure high frequency diffusion without absorption down to a specified cross-over frequency and then transitions into pure absorption below this frequency. Several attempts have been described using binary and ternary sequences to accomplish this. The limitation of these sequences is the fact that they include a binary zero, which introduces unwanted accompanying absorption to the high frequency diffusion, thus reducing its effectiveness. The present invention solves this problem by describing a new class of acoustical ceiling tile and wall panels which provides high frequency diffusion, without any accompanying sound absorption, above a specified cross-over frequency, and then transitions into a pure absorber below the cross-over frequency. In some cases, the diffusive surface is designed using a mathematical number theory sequence devoid of the binary zero (0) to preclude sound absorption above the transition frequency. The absorption cross-over frequency can be designed to extend in a range from mid to low frequencies. This new transitional panel essentially is the "holy grail" of acoustical panels and offers the possibility to control reflections and reverberation in a manner that is desirable for almost any type of space including, classrooms, lecture halls, meeting rooms, offices, rehearsal spaces, performance spaces, recording/broadcast studios and commercial and home theaters. In effect, these novel surfaces overcome the limitations of traditional acoustical ceiling tile and fabric wrapped panels and can result in higher speech intelligibility and an enhanced space to perform and audition music.

Reflection Phase Gratings: Diffusion without Absorption:

Diffusors can be used to improve the acoustics of enclosed spaces to enhance the experience of listening to music and make speech more intelligible. Early research in diffusors began by considering non-absorbing reflection phase grating surfaces, such as Schroeder diffusors. These surfaces consist of a series of wells of the same width and differing depths. The wells are separated by thin dividers. The depths of the wells are determined by a mathematical number theory sequence that has a flat power spectrum, such as a quadratic residue or primitive root sequence. Limitations of these early diffusors, including periodicity effects and flat plate frequencies, have been mitigated by a recent invention, U.S. Pat. No. 6,772,859, using embodiments of aperiodic tiling of a single optimized asymmetric diffusive base shape.

Binary Amplitude Diffusors: Diffusion with Accompanying High Frequency Absorption.

More recent research has concerned the development of hybrid absorber-diffusors; these are surfaces that are referred to as amplitude gratings and contain reflective and absorptive areas. The location of these areas is determined by binary mathematical sequences in which a 1 refers to a reflecting area and a 0 to an absorptive area or vice versa. As opposed to the reflection phase gratings, these binary amplitude absorber-diffusors inherently absorb-roughly 50% of the incident sound and diffuse the remaining energy. Applicant has described effective planar and optimized curvilinear two-dimensional binary amplitude sequences in U.S. Pat. Nos. 5,817,992 and 6,112,852, respectively. A problem with hybrid absorber-diffusors is that energy can only be removed from the specular reflection by absorption. While there is diffraction caused by the impedance discontinuities between the hard and soft patches, this is not a dominant mechanism except at low frequencies. Even with the most optimal arrangement of patches, at high frequencies where the patch becomes smaller than half the wavelength, the specular reflection is only attenuated by roughly 7 dB.

Ternary Diffusors: Improved Diffusion with Accompanying High Frequency Absorption.

If it were possible to exploit interference, by reflecting waves out of phase with the specular lobe, then it would be possible to diminish the specular lobe further. Applicant has found that this can be achieved by using a new class of hybrid diffusors combining the aspects of an amplitude grating with those of a reflection phase grating. These new surfaces contain the elements of an amplitude grating, namely reflective and absorptive patches, with the addition of additional reflective patches, in the form of wells a quarter wavelength deep at a specified design frequency, which can constructively interfere with the zero-depth reflective patches. The simplest form of these hybrid gratings is an absorber-diffusor with a random or pseudo-random distribution. But a more effective design is based on a ternary sequence, which nominally has surface reflection coefficients of 0, 1 and −1. The wells with the pressure reflection coefficient of −1 typically have a depth of a quarter of a wavelength at the design frequency and odd multiples of this frequency to produce waves out of phase with those producing the specular lobe, i.e. the wells with a pressure reflection coefficient of +1. This results in a better reduction of the specular reflection. Ternary sequences are therefore an extension of the binary amplitude diffusor and are an alternative way of forming hybrid absorber-diffusors, which achieve superior scattering performance for a similar amount of absorption, as the BAD panel. Applicant has described these hybrid amplitude-phase grating diffusors in U.S. Pat. No. 7,428,948 B2.

While interference effects in the ternary diffusors improve the diffusion by lowering the specular component, they still provide some unavoidable high frequency absorption, due to the pressure reflection coefficients of 0 in the sequence. This absorption reduces the amount of incident sound that can be constructively diffused or scattered. Therefore, it would be significant to remove all of the high frequency absorption above a certain transition frequency, so all of the incident sound could be diffused. In addition, the absorption of conventional acoustical ceiling tile and fabric wrapped panels is heavily weighted to the mid and high frequencies, which can often leave a space feeling acoustically "dead", because they typically only remove the frequencies above 1,000 Hz range which generate a sense of ambiance and contribute to speech intelligibility. Since other elements in the room, such as drapery, carpeting and people also absorb preferentially in the high-mid frequency region, additional absorption of acoustical ceiling tile and fabric wrapped panels, often further unbalance the reverberation time and can actually give the perception of too much low frequency sound in the room. While these acoustical ceiling tiles and fabric wrapped panels may prevent complicating reflections, what is really needed is a ceiling tile or panel that diffuses the high frequencies, thus removing interfering reflections while maintaining the sound as ambiance, and absorbs the mid and low frequencies, which are perceived as low frequency reverberance or boominess. This reverberation can reduce speech intelligibility by decreasing the signal (the wanted information) to noise (the reverberation) ratio.

The present invention describes a new technique to solve this problem. The approach is to return to the concept of the original non-absorbing reflection phase gratings, with a significant difference. Instead of making the diffusors non-absorbing over a wide frequency range, the present invention diffuses incident energy above a transition frequency and absorbs the remaining transmitted energy below the transition frequency by a number of approaches as will be explained hereinafter.

SUMMARY OF THE INVENTION

The present invention relates to an acoustical treatment with transition from absorption to diffusion and method of making.

The present invention includes the following interrelated objects, aspects and features:

(1) In a first aspect, the present invention relates to a new class of hybrid acoustical surface, which provides both sound diffusion and absorption. The key aspect of the invention is the fact that a single surface can transition from pure diffusion above a specified cross-over frequency to pure absorption below this frequency. Previous attempts have been made, using variable impedance binary and ternary surfaces. These surfaces contain patches of absorption and reflection to provide diffusion, but they have limited use, because of the inherent absorption at high frequency.

(2) The transitional surface in accordance with the teachings of the present invention overcomes this limitation, by offering pure diffusion at high frequencies transitioning into pure sound absorption below a transition frequency. This transitional surface is fabricated from a thin diffusive fascia, which inserts into a complementary formed absorptive backing or from a diffusively shaped absorptive core, which is treated with a reflective coating or from a thin diffusive fascia which is attached to a flat porous absorptive core. In all cases the diffusive fascia is designed to reflect high frequency sound above the cross-over frequency and transmit sound below it through the fascia rearward toward the absorptive core.

(3) The 1-dimensional or 2-dimensional high frequency diffusive fascia can be designed using a wide range of methodologies, including random distributions of scattering elements, or more effectively using a mathematical number theory sequence having a flat power spectrum, like quadratic residues, primitive root, Luke, power spectrum. In addition, optimized rectilinear and curvilinear diffusive fascia can be designed using boundary element or other shape optimization theory.

(4) The absorption below the transition frequency is typically achieved using a porous backing of fiberglass, polyester, mineral wool, recycled sintered glass or stone or similar absorptive materials. The absorption efficiency extends to a lower frequency as the thickness of the porous absorptive backing and its spacing from the mounting surface increase.

OBJECTS OF THE INVENTION

As such, it is a first object of the present invention to provide a hybrid diffusor-absorber consisting of a 1D (extruded shapes offering single plane hemidisc scattering) or 2D (shapes with depth variation in two directions offering multiple plane hemispherical scattering) diffusive fascia which diffuses uniformly (as verified by ISO 17497-1 and ISO 17497-2) down to a specified transition frequency and then transmits sound to a mid-low frequency absorbing backing below the transition frequency.

It is a further object of the present invention to form a thin 1D or 2D diffusive fascia which transmits sound rearwardly therethrough below a specified transition frequency.

It is a further object of the present invention to form the 1D or 2D diffusive fascia using a random series of divided wells, non-divided steps or holes of any shape.

It is a further object of the present invention to form the 1D or 2D diffusive fascia using mathematical number theory sequences, like quadratic residue, primitive root, Luke, Chu, Hoffman, Power Residue and other sequences.

It is a still further object of the present invention to use modulation techniques on a single asymmetric base shape diffusor or multiple diffusors, using random orientation or optimal binary codes, like Barker or MLS, to further improve the diffusion.

It is a further object of the present invention to use a porous absorptive core behind an acoustically transparent diffusive surface.

It is a further object of the present invention to use a porous absorptive core fabricated into a diffusive shape by routing a porous panel, like fiberglass, mineral wool, recycled sintered glass or stone or any other porous material.

It is a still further object of the present invention to mold the porous core out of an open cell plastic, recycled sintered glass or stone or other moldable material resulting in an open cell structure.

It is a further object of the present invention to mold the porous core out of an open cell plastic or other moldable material resulting in an open cell structure that contains a non-porous fascia skin that reflects sound above the specified transition frequency.

It is a further object of the present invention to describe the design of panels that can be either wall mounted or inserted into a ceiling T-Bar grid exposed or hidden behind a veil, forming hybrid diffusor/absorbers.

It is a further object of the present invention to design the transition frequency to increase the signal to noise ratio of speech, thereby enhancing speech intelligibility by uniformly diffusing the 2-6 kHz speech consonants, thus increasing the signal, and absorbing the frequencies below that, thereby lowering the noise.

It is a further object of the present invention to provide a more uniform reverberation time in a room by uniformly diffusing the high frequencies and absorbing the mid-low frequencies.

It is a further object of the present invention to disclose designs for an improved acoustical ceiling tile which does not absorb preferentially at high frequency and provides both high frequency diffusion and mid-low frequency absorption.

It is a further object of the present invention to disclose designs to conceal the diffusive topology with an acoustically transparent glass fiber veil, textile or other fascia to make the product aesthetically appealing for ceiling grid and wall architectural applications.

It is a still further object of the present invention to provide a method of making the inventive device.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1:
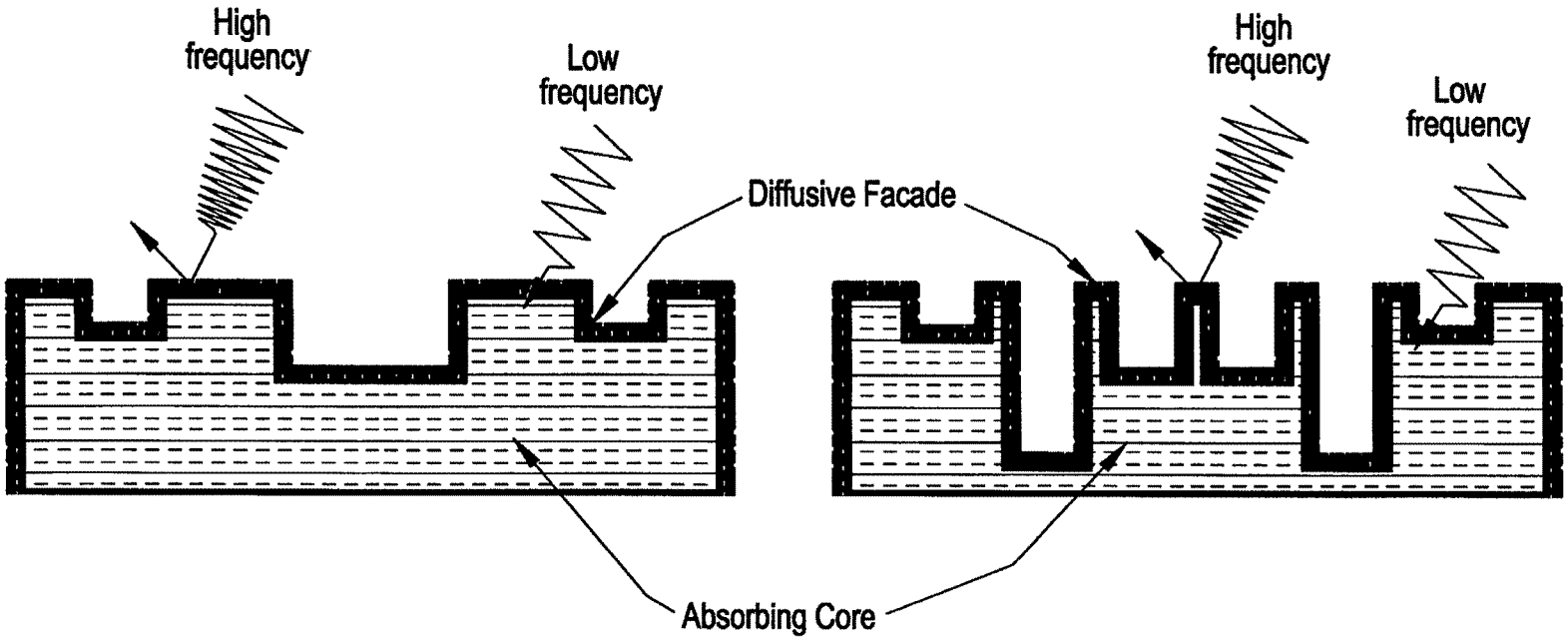
FIG. 1 shows two diffusing surfaces with and without dividers showing a transparent high frequency diffusing face, which allows low frequencies to penetrate and be absorbed by an absorptive core.

In FIG. 1, shown are two thick solid lined diffusive shapes nested into respective absorptive material cores (dashed pattern). On the left, the diffusive shape does not contain dividers, whereas the one on the right includes dividers. An incident sound wave (incoming arrow) of high frequency is scattered (outgoing arrow) by the diffusive surface, while the incident low frequency wave passes through the diffusive surface and is absorbed by the absorptive core.

Figure 2:
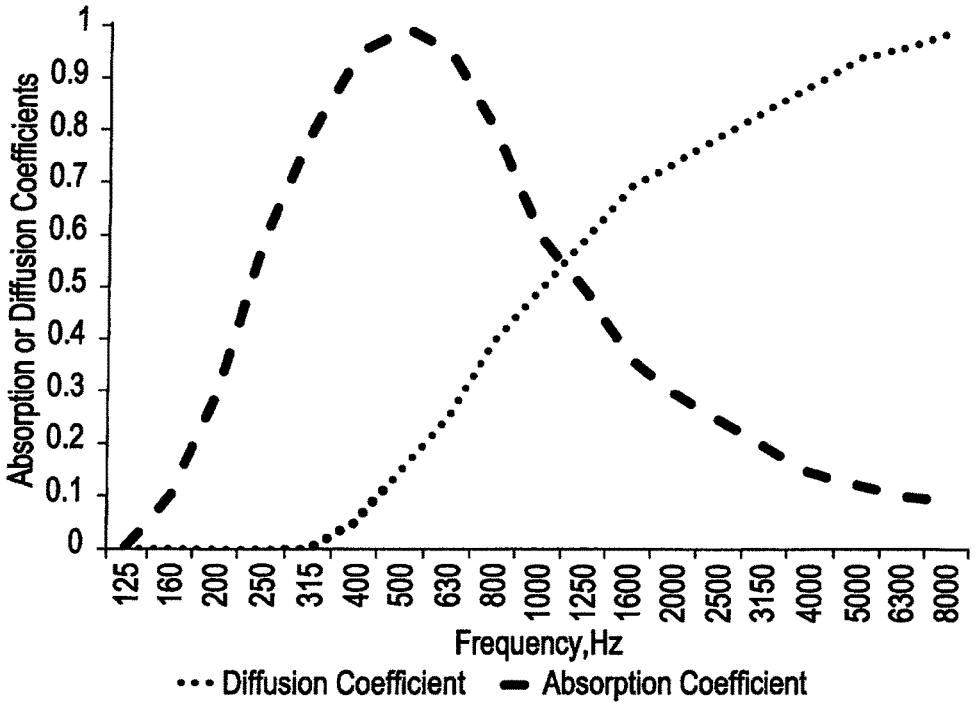
FIG. 2 shows a graph illustrating high frequency diffusion (dotted line) as indicated by the diffusion coefficient metric and low frequency absorption (dashed line) as indicated by the absorption coefficient.

In FIG. 2, shown is a schematic graph of the absorption (alpha) (dashed line) and diffusion (d) (dotted line) coefficients indicating the transition from diffusive high frequency behavior (dotted line) as indicated by the diffusion coefficient to absorptive low frequency absorption (dashed line) as indicated by the absorption coefficient.

One approach, as shown in FIG. 1, to provide this transitional behavior is to fabricate the high frequency one- or two-dimensional diffusors with a thin material, such as a formed or molded plastic, that reflects sound above a transition frequency and transmits sound below this frequency to a sound absorbing backing or core material. This core can either be molded into a 1D or 2D diffusive shape out of a suitable porous foam, recycled glass, perlite, stone or glass/mineral fiber, or fabricated by routing with a router a porous absorber board product to contain holes or wells. The face of the absorptive backing has the shape of the rear of the diffusive face and, as such, the fascia is able to snugly fit into absorptive backing forming a composite unit.

Another approach is to apply a coating over the absorptive material which when hardened provides high frequency diffusion, but transmits sound below the transition frequency to an absorptive core. This paint, resin, powder, epoxy or other thin and hard coating is applied directly to the diffusively shaped absorptive backing. Another approach would be to anneal the surface of a suitable porous material to form a sound barrier, which reflects sound above a specified cross-over frequency.

The well design of the fascia and its thickness, which determine the cross-over frequency between diffusion and absorption will be described below. This invention differs from the previously described binary and ternary diffusors in that it utilizes sequences, random, or optimized curvilinear or rectilinear topologies that do not contain a 0 reflection factor, thereby providing un-attenuated high frequency diffusion. This is significant, because all of the high frequency sound, above the transition frequency, can now be diffused without some of it being attenuated. This differs from the early number theoretic reflection phase gratings, in that the fascia is acoustically transparent below a defined transition frequency, rather than being completely rigid and reflective at all frequencies. In addition, the phase grating fascia reduces the specular component solely due to interference, which provides greater attenuation than previous approaches using an amplitude or ternary grating.

Figure 3:
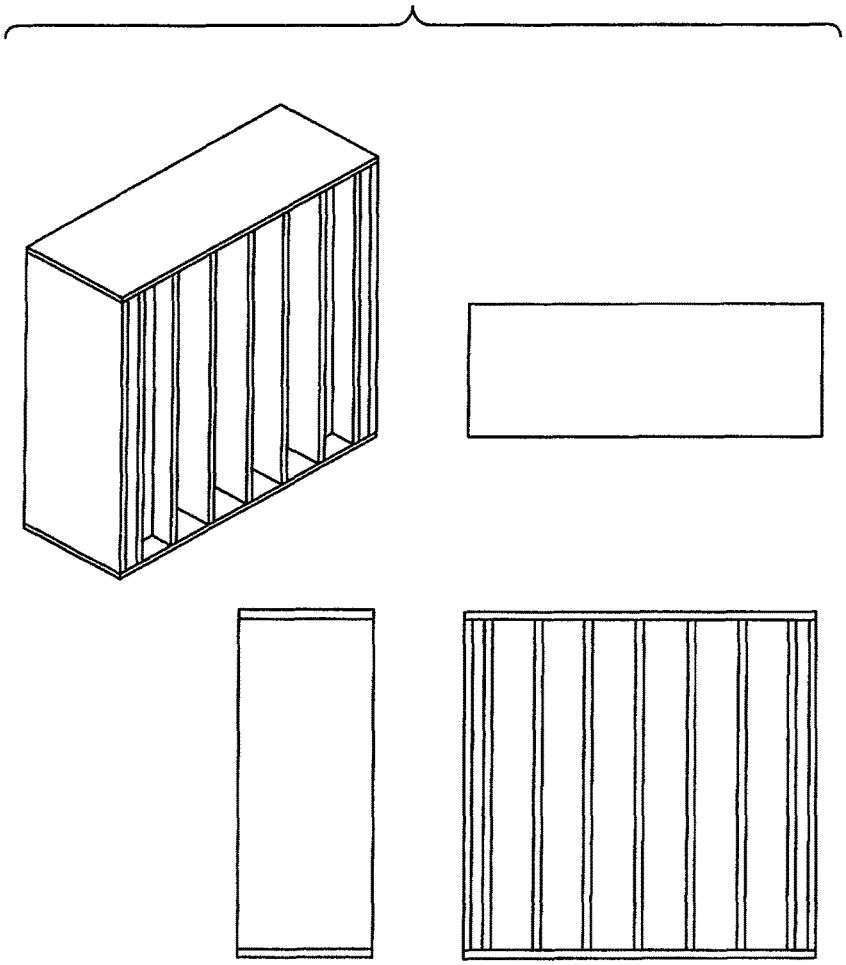
FIG. 3 shows views of a 1D Reflection Phase Grating.
Figure 4:
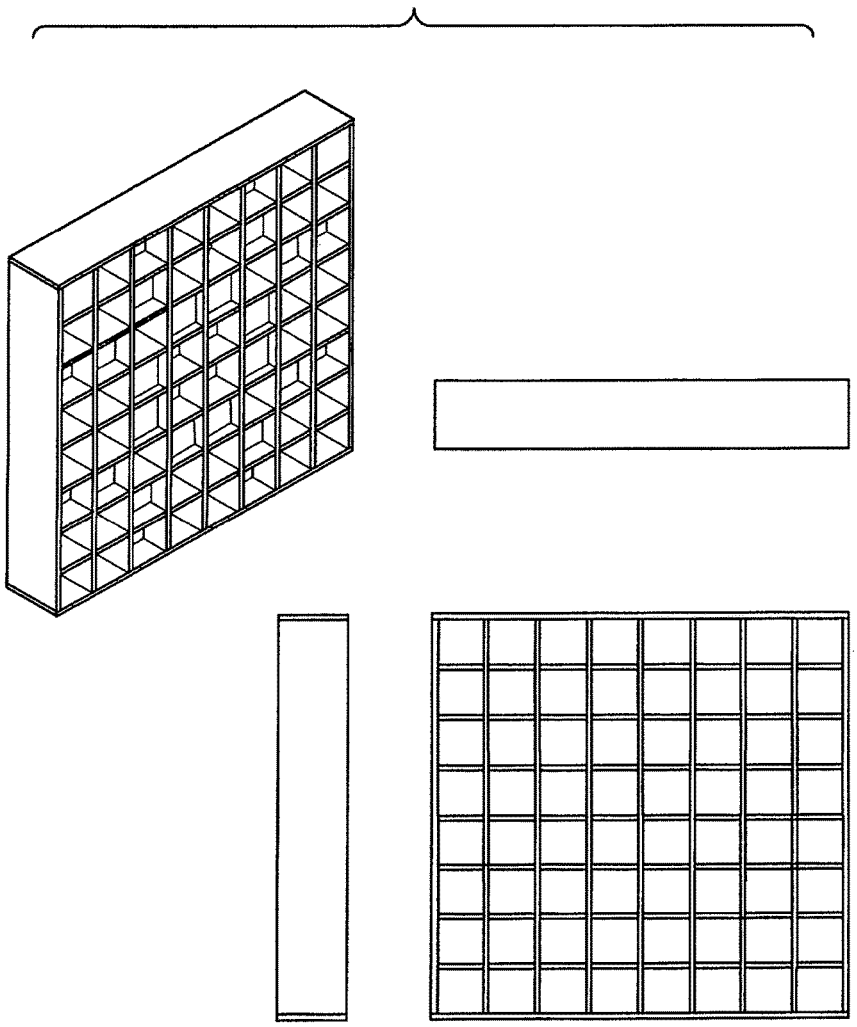
FIG. 4 shows views of a 2D Reflection Phase Grating Diffusor.
Figure 5:
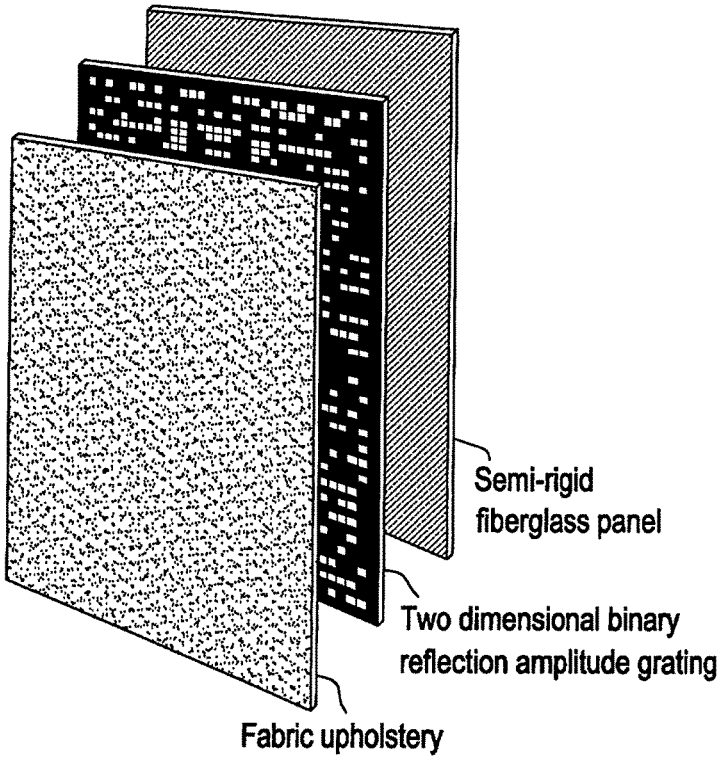
FIG. 5 shows an exploded perspective view of a 1D Binary Amplitude Diffusor, with absorptive shaded areas and reflective white areas.
Figure 6:
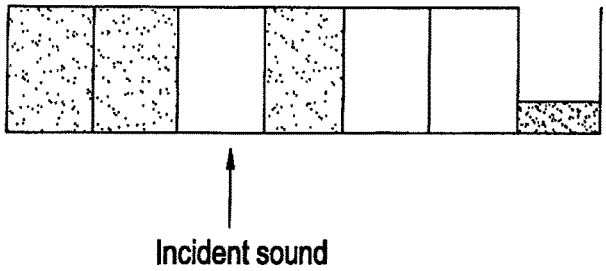
FIG. 6 shows a 1D Ternary Diffusor, with absorptive shaded areas, reflective white areas, and a quarter wavelength deep well at the right hand end which interferes with the reflective areas, thereby decreasing the specular energy.

In FIGS. 3 and 4, shown are typical designs for 1D and 2D number theoretic surfaces which were introduced in the early 1980s. These surfaces were designed to diffuse all of the incident sound over a wide frequency range and offer as little absorption as possible. The surfaces had a form which followed their function. When a flat surface was required, Assignee RPG Diffusor Systems, Inc. developed the binary amplitude panel, seen in FIG. 5, which was a flat panel providing limited diffusion from its variable impedance surface formed by holes whose location was determined by an optimal binary sequence. While these surfaces offered a desired aesthetic and useful diffusion, they also inherently provided roughly 50% absorption in the diffusion range, thereby compromising the amount of diffuse energy. To minimize the absorption and reduce the specular lobe (energy scattered at an angle equal to the angle of incidence), RPG introduced a flat diffusor incorporating a series of quarter-wavelength deep wells based on a ternary sequence, which interfered with the reflective areas improving diffusion. An example can be seen in FIG. 6. While this represented an improvement, the absorptive areas in the ternary sequence still provided undesirable high frequency absorption.

At that time, the architectural acoustics industry had a range of acoustical surfaces from which to choose. There was the purely absorptive surface treatment, like a fabric wrapped panel or acoustical ceiling tile, which offered no diffusion; a binary or ternary surface offering high frequency diffusion, limited high frequency absorption and fully diffusive surfaces offering broad bandwidth diffusion. However, what was missing was a surface for walls and ceilings that offered pure high frequency diffusion, undiminished by accompanying absorption, which transitioned into pure mid-low frequency absorption. This invention was unknown. Such a transitional surface is much needed in architectural acoustics, because it provides uniform high frequency scattering to improve speech intelligibility and music performance and audition, while simultaneously absorbing mid and low frequencies to balance the reverberation and sound decay in a space. This new hybrid surface is the essence of the present invention.

Figure 7:
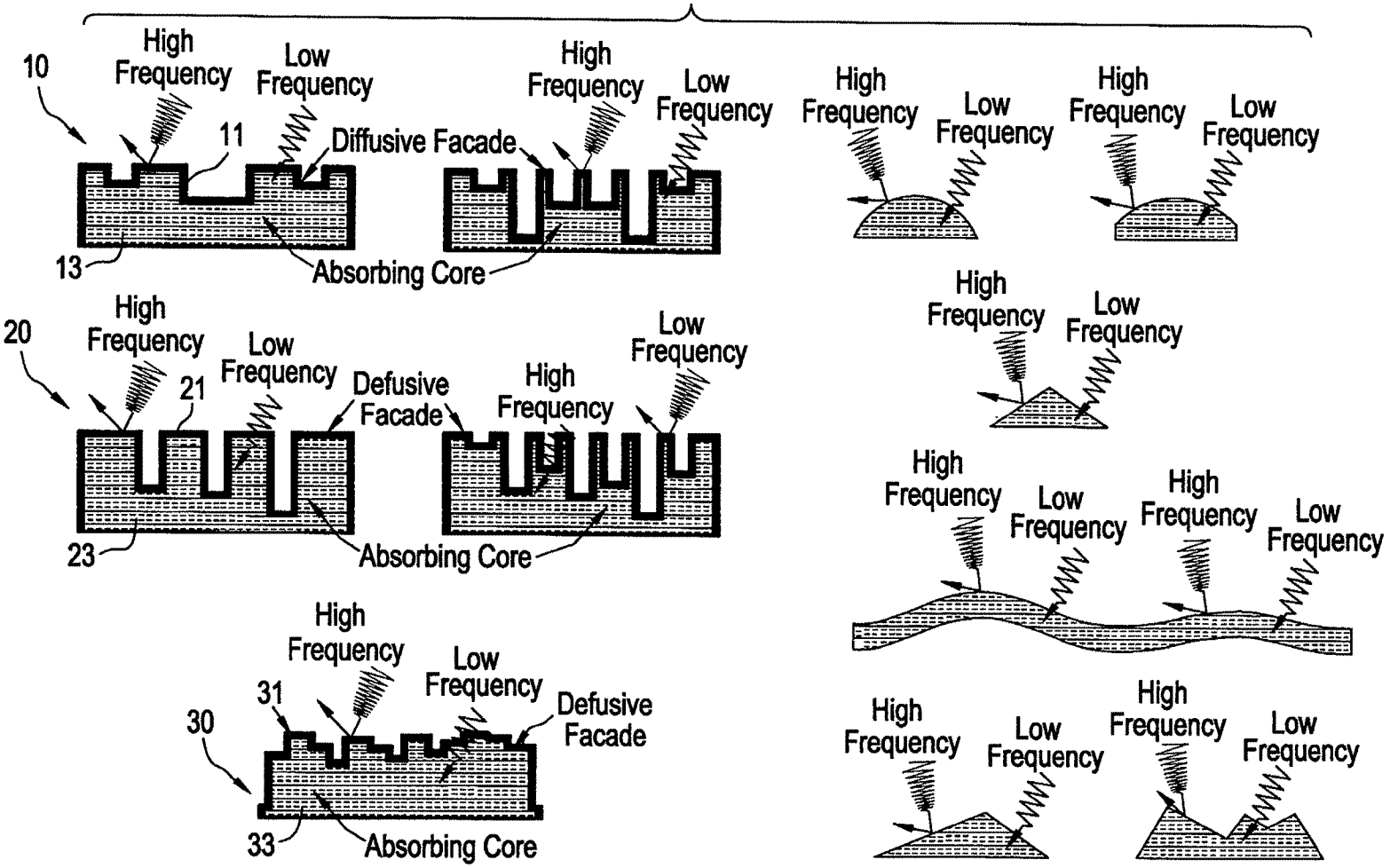
FIG. 7 shows 1D examples of various types of one-dimensional diffusive fascia.

FIG. 7 shows a range of potential 1D diffusive fascia that can be used to form a transitional diffusor/absorber. This list is not exhaustive and only indicates the unlimited shapes that can be used. The figure includes number theoretic diffusors (QRD734, MODF), 2D Skyline shapes (Applicant's U.S. Pat. No. 5,401,921), simple arcs, cylinder or polycylinders, barrel shapes, pyramids, splines, angled ramps, essentially any surface that will scatter sound. It should be understood, that while any surface will provide scattering, engineered surfaces based upon number theory and optimization theory will offer the highest performance. Optimized surfaces have been described by the Applicant in U.S. Pat. No. 6,772,859. It should be understood that increasing the depth of the 1D or 2D surface topology and the thickness of the fascia on which the surface topology is created, regardless of the design methodology, will result in lowering the diffusion limit and hence the transition frequency. The high frequency diffusion limit will increase as the size of the scattering elements decreases. Additional improved diffusive performance can be achieved by modulating the orientation of these diffusive surfaces as taught in Applicant's U.S. Pat. No. 6,772,859.

The first embodiment 10 at the top of FIG. 7 (QRD734), consists of a thin diffusive fascia 11 over a porous absorptive backing 13. In this embodiment, the diffusive fascia 11 is 1D and consists of divided or stepped wells, whose depths are designed using a random distribution. An improved embodiment below it 20 in FIG. 7 (MODF), consists of a thin diffusive fascia 21 made of divided or stepped wells, whose depths are determined using number theory sequences, such as quadratic residue, primitive root, Chu, power residues, Luke or Boundary Element optimization theory, as well as optimized or non-optimized curvilinear sinusoidal and spline shapes. The fascia 21 covers a porous absorptive backing 23. The SKYLINE diffusor 30 has a thin diffusive fascia 31 covering a porous absorptive backing 33.

Figure 8:
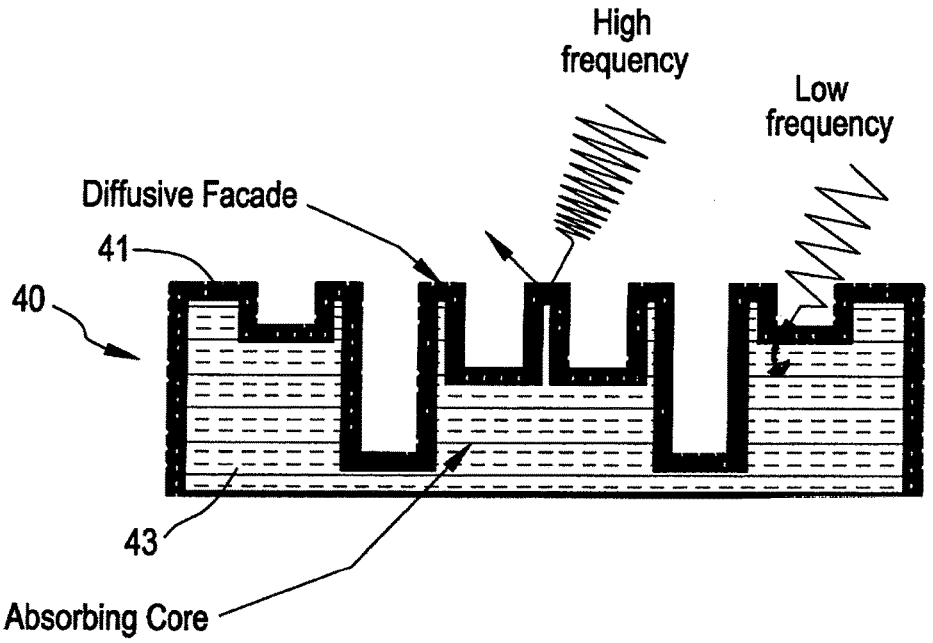
FIG. 8 shows a view of a 1D diffusive transitional diffusor showing the diffusive facade and the absorptive core.

A view of a 1D diffusive fascia 41 and its shaped absorptive backing 43 in a 1D diffusor 40 is shown in FIG. 8. In this embodiment, the thin diffusive fascia 41 can be either vacuum formed or injection molded out of a thin plastic or other suitable material. The absorptive backing would then be either formed or routed using a router with a similar pattern to accept the molded diffusive fascia.

Figure 9:
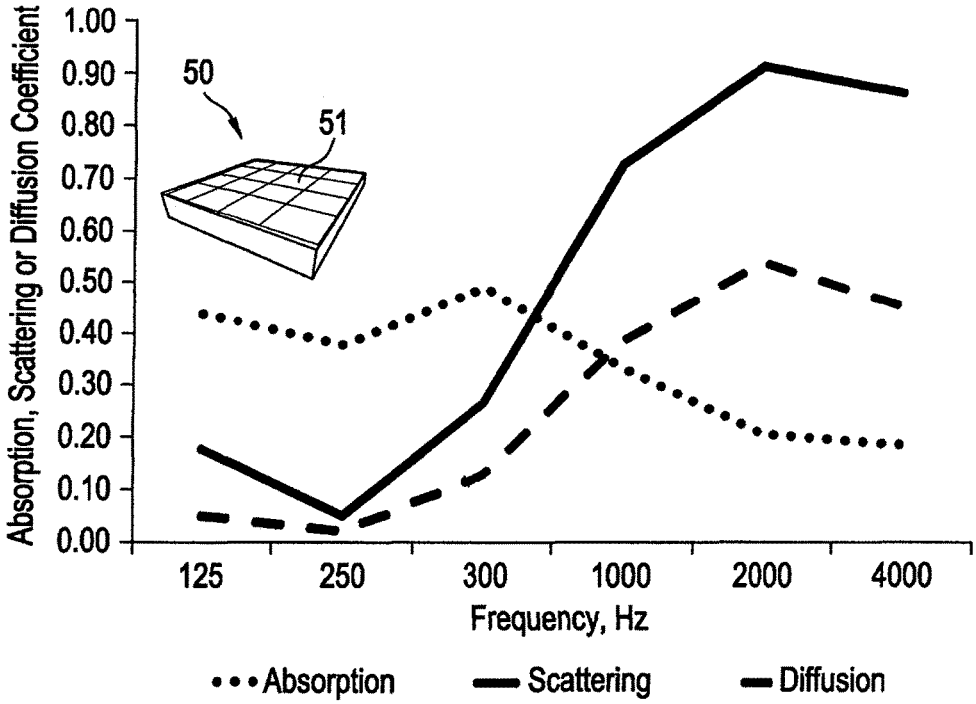
FIG. 9 shows a graph depicting the absorption, scattering and diffusion coefficients for a 1D transitional diffusor including an image of the diffusor in an E mount in a test reverberation chamber where the absorption data was determined.

In FIG. 9, shown is a thermoformed 1D diffusor 50 over an absorptive core in an E mount in a reverberation chamber. The graph of FIG. 9 shows absorption, scattering and diffusion versus frequency for the device 50. As seen, the transition between absorption and diffusion is between the 500 Hz and 1000 Hz octave bands, where the dotted line intersects the solid line.

Figure 10:
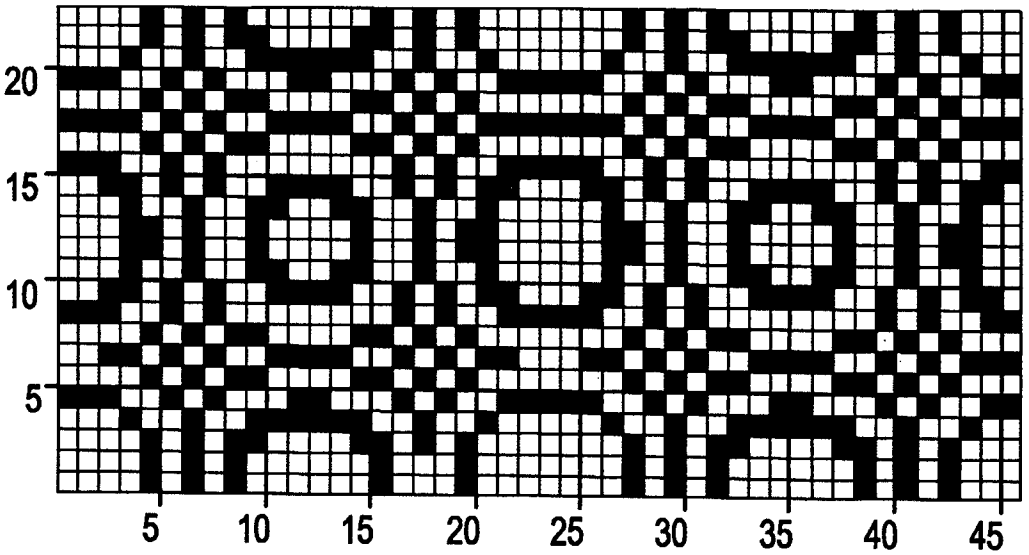
FIG. 10 shows an example of two repeats side by side of a QRD diffusor based on prime number 23.

FIG. 10 shows an example of a 2D transitional diffusor surface consisting of two periods of a QRD diffusor based on a prime number of 23. The diffusor is 1" thick and is intended to be inserted into a T-bar ceiling grid and backed with a porous absorptive core. As mentioned above, these are but some of many number theory sequences and other 2D topologies, which range from random topologies to optimized surfaces as described in Applicant's U.S. Pat. No. 6,772,859.

Figure 11:
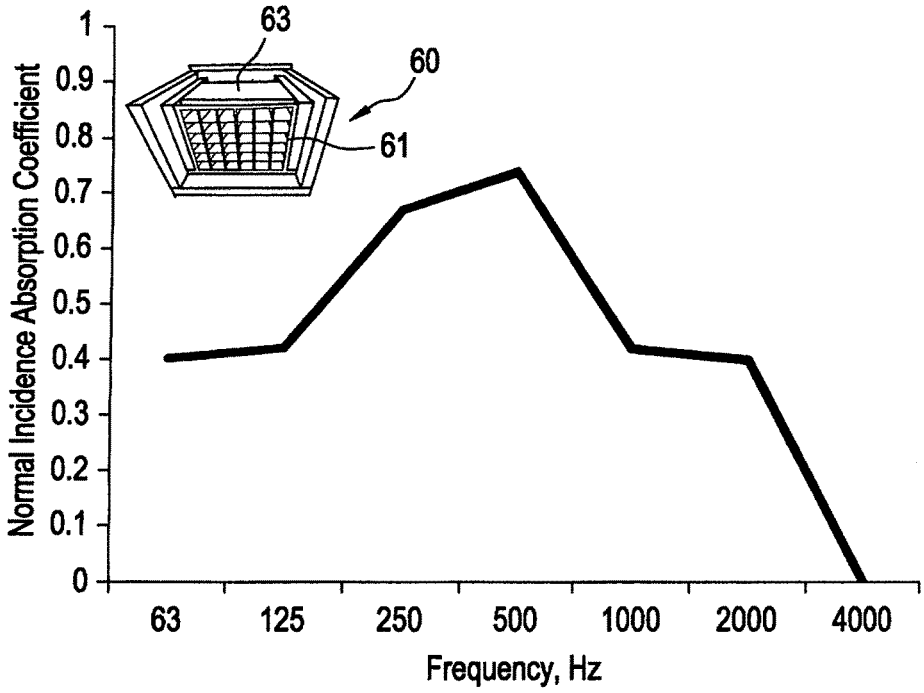
FIG. 11 shows a graph of normal incidence absorption of a 2D transitional diffusor fascia in front of a 2" porous core in an impedance tube with an image of the 2D acoustic device.

FIG. 11 shows a graph showing a transition frequency of about 500 Hz between absorption and diffusion for a 2D diffusor 60 having a thin diffusor fascia 61 and behind the fascia 61 an absorptive layer 63.

Figure 12:
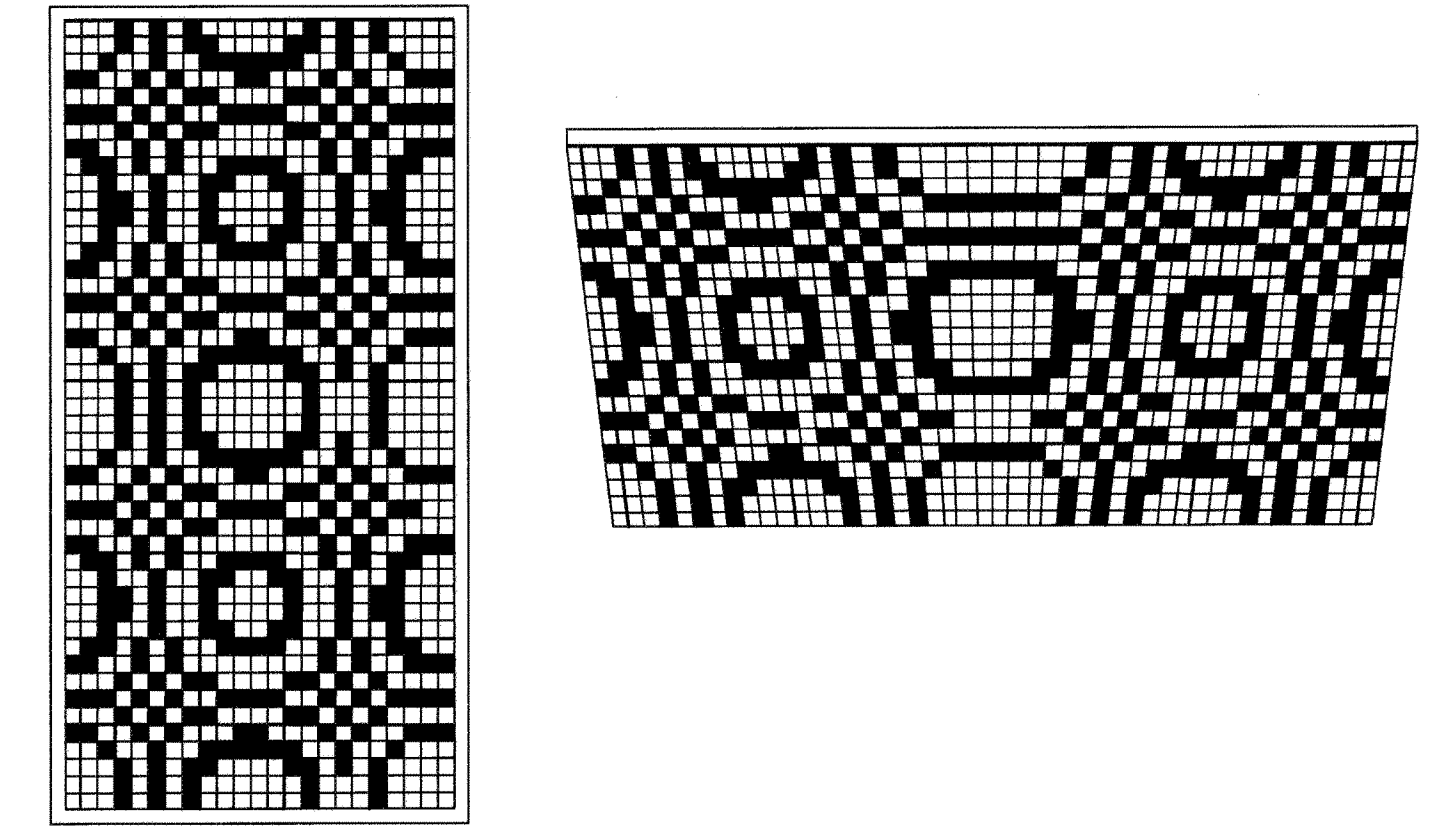
FIG. 12 shows a 1" deep thermoformed prototype of two periods vertically of a QRD prime number 23 transition diffusor intended as a lay-in panel in a T-bar ceiling.

FIG. 12 shows a 1" deep thin-walled thermoformed prototype of a diffusor intended to be installed as a lay-in panel in a T-bar ceiling. The transitional diffusive fascia designated by the reference numeral 70 shows two periods of a QRD prime number 23 configuration.

Applicant has demonstrated the diffusive performance of number theory and other optimized surfaces in his book entitled "Absorbers and Diffusors: Theory, Design and Application", $2^{nd}$ Ed., published by Taylor and Francis (2009). To further demonstrate the uniqueness of this invention compared to traditional broad bandwidth diffusors, in FIG. 11 we show the normal incidence absorption coefficient for this transitional 2D diffusive fascia to illustrate how low frequencies are transmitted through the fascia, while high frequency absorption is minimal, thus allowing the surface to diffuse these higher frequencies.

It should be understood that increasing the depth of the surface topology and the thickness of the material of the fascia on which the surface topology is formed, regardless of the design methodology will result in lowering the diffusion limit and hence the transition frequency. The high frequency diffusion limit will increase as the size of the scattering elements decreases.

Figure 13:
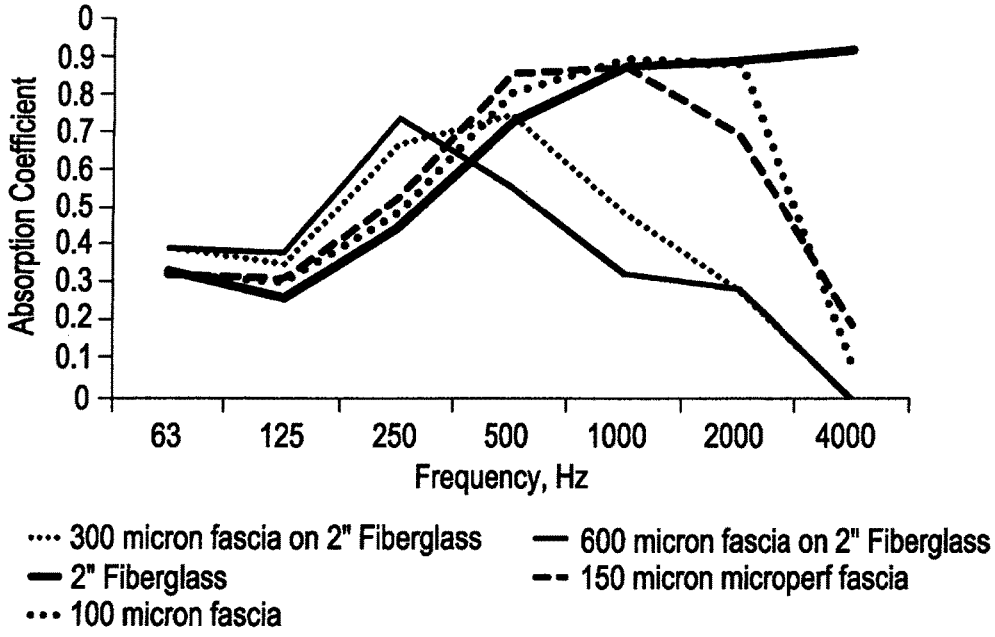
FIG. 13 shows a graph showing transition frequency between absorption and diffusion for 5 examples of differing thickness fascia.

With reference to FIG. 13, the essence of the present invention is that the thickness of the diffusive fascia is directly correlative of the transition frequency between absorption and diffusion. Applicant has found that the thicker the fascia, the lower the transition frequency. Thus, with reference to FIG. 13, it is easy to see the following: For a fascia 600 microns thick, the transition between absorption and diffusion is at about 250 Hz; for a fascia having a thickness of 300 microns, the transition frequency is at about 500 Hz; for a micro-perforated fascia having a thickness of 150 microns, the transition frequency is at about 1,000 Hz; for a fascia having a thickness of 100 microns, the transition frequency is at about 2,000 Hz.

Thus, in considering the listening characteristics desired, one need only determine the desired transition frequency between absorption and diffusion and provide a diffusor having a fascia of the desired depth and thickness of material that corresponds to the desired transition frequency, and install the fascia with an absorptive backing so that sound waves below the transition frequency travel through the fascia and are absorbed by the absorptive material while sounds having frequencies above the transition frequency are diffused back into the listening area.

In other words, the face of the acoustical device is fabricated from a thin material which has a sound diffusing topology. By tailoring the thickness and density of this diffusing surface, Applicant can determine the transition frequency as better explained in FIG. 13. Several thin, high frequency sound transmitting fascia are described. The absorption can be designed to extend in a range from mid to low frequencies. This new transitional panel essentially is the "holy grail" of acoustical panels and offers the possibility to control reflections and reverberation in a manner that is desirable for almost any type of space including classrooms, lecture halls, meeting rooms, offices, rehearsal spaces, performance spaces, recording/broadcasting studios and commercial and home theaters. In effect, these novel surfaces overcome the limitations of traditional acoustical ceiling tile and fabric wrapped panels and can result in higher speech intelligibility and an enhanced space to perform and audition music.

The primary applications of this novel surface are as an improved ceiling tile and wall panel. Acoustical ceiling tiles help to reduce sound reverberation and provide acoustical absorption in a room, an important factor in noisy environments such as office ceilings, commercial interiors, transportation facilities, schools or residential projects. All ceiling tiles only provide absorption at mid and high frequencies. The present invention describes a new class of ceiling tiles which offer both diffusion and absorption. The tiles can be machined from a flat absorptive panel, such as mineral or glass fiber or molded, using a porous material like recycled sintered glass, stone, perlite, etc., to have a diffusive topology and then coated with a reflective coating or formed from a composite diffusive layer which covers an absorptive layer.

Thus, it is shown that the transition frequency between absorption and diffusion can be adjusted between roughly 250 Hz to 2,000 Hz. The desired frequency is determined by the purpose of the hybrid device. For example, in a room in which speech intelligibility is important, early reflections improve the Signal To Noise ratio, which is important for speech intelligibility. The power of speech is contained in the vowels, which occur between 250-500 Hz. However, the intelligibility is determined by the consonants, which occur between 2,000 and 6,000 Hz. The signal consists of the direct sound and the early reflections, which arrive in up to roughly 50 ms. The human auditory system combines the direct sound and early reflections to yield a louder and more intelligible sound. The noise consists of external intrusion, HVAC noise, occupant noise and reverberation. This is reduced by adding mid-to-low frequency absorption. If there is insufficient absorption in the 250-500 Hz range, these frequencies can mask the information content at higher frequencies. Therefore, it is not sufficient to simply decrease the noise by adding absorption, it is also necessary to provide early reflections to passively increase the signal. This is why the present invention provides a solution which reduces the reverberation below the transition frequency and adds beneficial early diffuse reflections above the transition frequency. The efficiency of sound diffusion is determined by the design of the diffusing fascia, several of which are described in this disclosure. The efficiency of the absorption is determined primarily by the thickness of the absorptive core. In the case of a room in which speech intelligibility is important, a transition frequency of roughly 500-1,000 Hz would be effective.

The thickness and nature of the reflective coating is determined by the transition frequency. Thicker coatings will have a lower transition frequency. FIG. 12 is a 2'×4' thermoformed prototype of such a ceiling tile. An absorptive core can be molded into the rear shape and inserted or a porous panel can simply be laid on top to absorb the lower frequencies forming a composite panel. When used in a ceiling typically the porous panel will have an aluminum foil backing to allow the air cavity to be used for HVAC applications.

Fabric wrapped panels are also used extensively to absorb sound and control reverberation in commercial and residential applications. The same approaches can be applied to these wall panels for improved performance. If the appearance of the diffusive fascia is not desired, they can simply be covered with an acoustically transparent fabric, glass fiber veil, perf metal or other decorative treatments to conceal the acoustical functionality and blend with the architectural décor.

Figure 14:
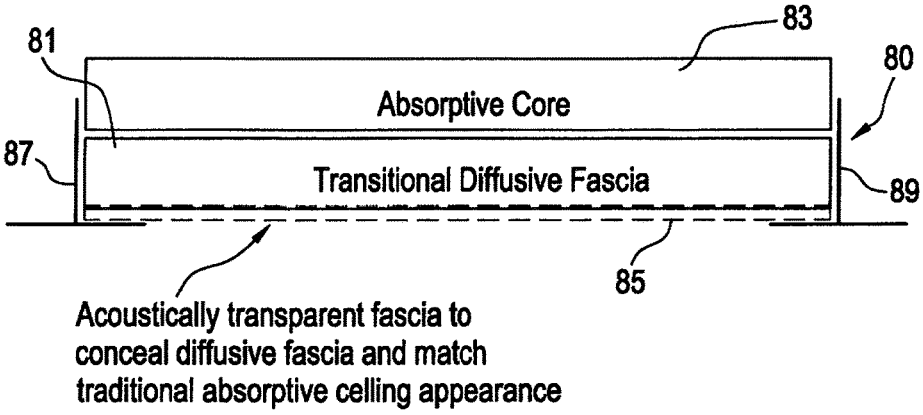
FIG. 14 shows a cross-sectional view of a diffusor/absorber in accordance with the present invention as mounted in a ceiling and hidden behind an acoustically transparent fascia or veil.

With reference to FIG. 14, as explained above, it is sometimes advantageous from an aesthetic standpoint to conceal the inventive acoustical device behind an acoustically transparent veil. For example, a ceiling may be composed of numerous ceiling tiles having a certain appearance. One may wish to substitute for some of these ceiling tiles an acoustical device as taught herein, but without revealing to those in the room or space that this is the case. As such, an acoustically transparent veil can be provided that closely resembles the other ceiling tiles and the present invention can be concealed behind the acoustically transparent veil.

Thus, with reference to FIG. 14, the acoustical treatment 80 has a transitional diffusive fascia 81 behind which is located an absorptive core 83. The device 80 is hidden behind an acoustically transparent veil 85 that is made to resemble the appearance of other adjacent ceiling tiles. T-bars 87 and 89 support the entire structure in what is commonly known as a drop ceiling. In this way, the functionality of the present invention is hidden behind an acoustically transparent veil but has equally effective function.

In addition, the interesting visual patterns of the various design sequences provide an artistic sculptural work of art to enhance the appearance of a wall or ceiling.

As should be understood from the above description, the present invention also includes the method of designing an acoustical treatment. The method includes the following main steps:

(1) Choose a transitional frequency that is desired or optimal between absorption and diffusion;

(2) Calculate the thickness of the diffusive fascia that is necessary to achieve the transitional frequency;

(3) Fabricate the fascia using any desirable theory for creating a diffusor as amply explained hereinabove;

(4) Fabricate an absorptive material that can sit behind the diffusive fascia and/or mimic its shape so that they are closely engaging one another;

(5) Decide whether the apparatus will be exposed or hidden behind a thin acoustically transparent veil;

(6) Assemble the components of the device and install the device in a desired location.

As such, an invention has been disclosed in terms of preferred embodiments of an acoustical treatment with transition from absorption to diffusion and its method of making of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

The invention claimed is:

1. An acoustical treatment comprising:

a) a thin fascia having a forward facing surface having a surface configuration acting as a sound diffusor, said forward facing surface being configured as a 1D or 2D diffusor;

b) said fascia having a rearward facing surface, said acoustical treatment including a sound absorbing core rearward of said rearward facing surface, said core absorbing sound waves entering said core after traveling through said thin fascia;

c) said fascia having a thickness determinative of a transition frequency between absorption and diffusion, a greater thickness resulting in a lower transition frequency and a lesser thickness resulting in a higher transition frequency.

2. The acoustical treatment of claim 1, wherein said surface configuration of said forward facing surface is configured through calculation of a mathematical number theory sequence devoid of a 0 reflection factor so that said forward facing surface prevents sound absorption above said transition frequency.

3. The acoustical treatment of claim 1, wherein said diffusor is devoid of a 0 reflection factor.

4. The acoustical treatment of claim 1, wherein said fascia has a thickness from 100 microns to 600 microns, said transition frequency being in a range of 2,000 Hz to 250 Hz.

5. The acoustical treatment of claim 4, wherein a fascia thickness of about 100 microns results in a transition frequency of about 2,000 Hz.

6. The acoustical treatment of claim 4, wherein a fascia thickness of about 600 microns results in a transition frequency of about 250 Hz.

7. The acoustical treatment of claim 4, wherein a fascia thickness of about 300 microns results in a transition frequency of about 500 Hz.

8. The acoustical treatment of claim 1, wherein said sound absorbing core engages said rearward facing surface.

9. The acoustical treatment of claim 8, wherein said thin fascia is made of injection molded or vacuum formed plastic.

10. The acoustical treatment of claim 8, wherein said thin fascia comprises a coating coated onto a forward facing surface of said sound absorbing core.

11. The acoustical treatment of claim 10, wherein said coating is chosen from the group consisting of paint, resin, powder and epoxy.

12. The acoustical treatment of claim 1, wherein said sound absorbing core is made of a material chosen from the group consisting of fiberglass, mineral wool, sintered glass and stone.

13. The acoustical treatment of claim 1, mounted in a ceiling.

14. The acoustical treatment of claim 13, wherein said thin fascia is hidden behind a sound transparent veil.

15. A method of making an acoustical treatment, including the steps of:

a) choosing a transitional frequency below which it is desired that sound absorption will occur and above which it is desired that sound diffusion substantially without sound absorption will occur;

b) calculating a thickness of a diffusive fascia, said thickness creating said transition frequency;

c) fabricating said fascia as well as a sound absorbing core, with said fascia having a forward facing surface configured as a 1D or 2D diffusor; and d) locating said sound absorbing core behind said fascia to form said acoustical treatment.

16. The method of claim 15, wherein said thickness is in a range of 100 to 600 microns and said transition frequency is in a range of 2,000 Hz to 250 Hz.

17. The method of claim 15, further wherein said fascia comprises a coating coated onto a surface of said sound absorbing core.

18. The method of claim 17, wherein said coating is chosen from the group consisting of paint, resin, powder and epoxy.

19. The method of claim 15, wherein said sound absorbing core is made of a material chosen from the group consisting of fiberglass, mineral wool, sintered glass and stone.

20. The method of claim 15, wherein said locating step includes the step of engaging a forward facing surface of said sound absorbing core with a rearward facing surface of said fascia.

* * * * *